US006571710B1

(12) United States Patent
Price

(10) Patent No.: US 6,571,710 B1
(45) Date of Patent: Jun. 3, 2003

(54) KEYLESS INKER FOR A PRINTING PRESS

(76) Inventor: James F. Price, 1305 Johns Dr., Euless, TX (US) 76039

( * ) Notice: Subject to any disclaimer, the term of this patent is extended or adjusted under 35 U.S.C. 154(b) by 0 days.

(21) Appl. No.: 09/507,549

(22) Filed: Feb. 18, 2000

Related U.S. Application Data

(60) Provisional application No. 60/122,765, filed on Mar. 3, 1999.

(51) Int. Cl.[7] ..... B41F 31/00

(52) U.S. Cl. ..... 101/483; 101/350.5

(58) Field of Search ..... 101/350.1, 350.4, 101/350.5, 350.6, 351.7, 352.06, 352.11, 367, 483

(56) References Cited

U.S. PATENT DOCUMENTS

| | | | | |
|---|---|---|---|---|
| 2,285,052 A | * | 6/1942 | Roesen | 101/350.4 |
| 2,613,600 A | | 10/1952 | McWhorter | |
| 2,986,088 A | * | 5/1961 | Chase et al. | 101/350.5 |
| 3,504,626 A | * | 4/1970 | Worthington | 101/350.5 |
| 3,587,463 A | * | 6/1971 | Granger | 101/350.1 |
| 3,611,924 A | | 10/1971 | Harrison | |
| 3,800,702 A | | 4/1974 | Roberts | |
| 4,040,348 A | | 8/1977 | Gertsch et al. | |
| 4,041,864 A | | 8/1977 | Dahlgren et al. | |
| 4,254,709 A | * | 3/1981 | Arnolds | 101/350.1 |
| 4,263,848 A | * | 4/1981 | Matalia et al. | 101/350.1 |
| 4,373,442 A | | 2/1983 | Dahlgren et al. | |
| 4,428,291 A | * | 1/1984 | Dorow | 101/352.13 |
| 4,453,463 A | | 6/1984 | Dahlgren et al. | 101/148 |
| 4,493,257 A | | 1/1985 | Kubert et al. | 101/349 |
| 4,527,471 A | | 7/1985 | Dahlgren et al. | |
| 4,527,479 A | | 7/1985 | Dahlgren et al. | 101/450.1 |
| 4,542,693 A | | 9/1985 | Mourrellone | |
| 4,685,414 A | | 8/1987 | DiRico | |
| 4,864,925 A | | 9/1989 | Van Kanegan et al. | |
| 5,033,380 A | * | 7/1991 | Sonobe et al. | 101/350.1 |
| 5,046,416 A | | 9/1991 | Freyer et al. | |

(List continued on next page.)

FOREIGN PATENT DOCUMENTS

| | | |
|---|---|---|
| DE | 1130 453 | 5/1962 |
| DE | 1130453 | 5/1962 |
| DE | 4424581 | 10/1995 |
| JP | 61106254 | 5/1986 |
| JP | 61-206254 | 5/1986 |
| WO | 83/04003 | 11/1983 |
| WO | 00/51817 | 9/2000 |

OTHER PUBLICATIONS

J. W. Freeman; Letter re: U.S. patent application 2001/0032559, Oct. 25, 1991 "Inking Systems for Printing Presses"; letter dated Jan. 10, 2003; 4 pages of letter and 8 pages of enclosure bearing dates in Aug., 1995.

Pamarco; Fiberlyte® Carbon Fiber Anilox Rolls Are Now a Reality; brochure.

Karat Digitial Press; Product Overview; The Next Tradition in Printing; brochure; (Karat Digital Press L.P.).

*Primary Examiner*—Eugene H. Eickholt
(74) *Attorney, Agent, or Firm*—Burns, Doane, Swecker & Mathis, L.L.P.

(57) ABSTRACT

A printing press having a keyless inking system. The inking system includes a single form roller for applying ink to a printing plate, and a transfer roller adjacent the form roller for removing excess ink from the form roller. A subtractive roller adjacent the transfer roller removes excess ink from the transfer roller, and a scraper blade adjacent the subtractive roller scrapes excess ink from said subtractive roller. An ink reservoir adjacent the scraper blade receives ink scraped from the subtractive roller, and supplies ink for application onto the form roller. An applicator roller adjacent the ink reservoir receives ink from the ink reservoir, and applies the ink to the form roller.

27 Claims, 6 Drawing Sheets

U.S. PATENT DOCUMENTS

| | | | | | |
|---|---|---|---|---|---|
| 5,178,065 | A | | 1/1993 | Reder et al. | |
| 5,178,678 | A | | 1/1993 | Koehler et al. | |
| 5,218,905 | A | * | 6/1993 | Bolte et al. | 101/350.1 |
| 5,259,313 | A | | 11/1993 | Gibson et al. | |
| 5,315,930 | A | | 5/1994 | Niemiro | 101/366 |
| 5,355,796 | A | * | 10/1994 | Köbler et al. | 101/350.1 |
| 5,355,799 | A | | 10/1994 | Lutz | |
| 5,425,809 | A | | 6/1995 | Person | |
| 5,452,660 | A | * | 9/1995 | Stein | 101/350.1 |
| 5,603,262 | A | | 2/1997 | Uera et al. | |
| 5,709,147 | A | * | 1/1998 | Uera et al. | 101/350.1 |
| 5,908,505 | A | | 6/1999 | Bargenquest et al. | |
| 5,983,799 | A | | 11/1999 | Lane, III et al. | |
| 6,006,664 | A | | 12/1999 | Hummel et al. | |
| 6,006,665 | A | | 12/1999 | Stuchlik et al. | |
| 6,055,907 | A | * | 5/2000 | Endisch et al. | 101/352.01 |
| 6,065,402 | A | * | 5/2000 | Feller et al. | 101/350.5 |
| 6,116,161 | A | | 9/2000 | Voge et al. | |
| 6,409,645 | B1 | | 6/2002 | Paasonen et al. | |

* cited by examiner

KEYLESS INKER FOR A PRINTING PRESS

CROSS-REFERENCE TO RELATED APPLICATIONS

This application claims the benefit of U.S. Provisional Patent Application No. 60/122,765 filed on Mar. 3, 1999.

STATEMENT REGARDING FEDERALLY SPONSORED RESEARCH OR DEVELOPMENT

Not Applicable.

FIELD OF THE INVENTION

The field of the invention is printing presses, and more particularly, inking systems for printing presses.

BACKGROUND OF THE INVENTION

An offset printing press typically includes a plate cylinder carrying a printing plate. The printing plate has oleophilic surfaces defining an image area, and hydrophilic surfaces defining a non-image area. An inker applies ink to the printing plate which collects on the oleophilic surfaces to form an image which can be transferred to a blanket cylinder which transfers the image to media. By transferring the image from the printing plate onto a blanket roller, and then onto the media, the printing plate does not directly print the image on the media, hence the term offset printing.

The inker applies ink carried on one or more form rollers to the printing plate. When the form roller in the inker engages the printing plate, the ink film on the form roller contacting image areas on the printing plate is split such that approximately one-half of the thickness of the ink film is applied to the image area of the printing plate leaving approximately one-half the ink on the form roller causing a condition referred to as starvation. The ink film on the form roller contacting non-image areas on the printing plate remains on the form roller causing a condition called accumulation, with no ink being transferred to the non-image area of the printing plate.

This combination of accumulation and starvation results in undesirable "ghosted" image being formed on the final printed product. In order to minimize this problem, conventional inkers include a plurality of form rollers which applies a small amount of ink each. However, a single form roller inker is less complicated, and can provide a superior final printed product because of the new uniform application of ink with each revolution of the printing plate.

The printed product is monitored to determine when ink color has degraded beyond an acceptable level. In order to control the quality of the printing, conventional printer inkers also include a plurality of adjustable keys to control the amount of ink being applied to the form roller. These keys require constant adjustment to maintain the quality of the printed product.

One attempt to provide a keyless inker incorporated a reverse roller in pressure indentation contact with a main form roller to meter the ink and erase the previous image on the form roller. This prior art inker provided an even film of ink on the printing plate, and prevented the accumulation and starvation of ink on the form roller. This reverse roller imposed a counter rotating force to the main form roller which increased the power requirements for operating the printing press. In addition the friction caused by the counter rotating roller generated a tremendous amount of heat that had to be "taken away," resulting in more horse power and satellite refrigeration equipment at each printing assembly.

In U.S. Pat. No. 4,453,463, an inker is disclosed for a lithographic printing press in which dampening fluid is applied to a resilient form roller. A blade is mounted to remove the dampening fluid and excess ink directly from the resilient form roller surface. The form roller is rotated into the leading edge of the doctor blade, which is pressure indented to the form roller, and increases the power requirements for rotating the form roller. Furthermore, the blade has a tendency to damage the form roller resilient surface.

U.S. Pat. No. 4,527,479 discloses a method and apparatus for continuously using ink and dampening fluid in a printing system which includes removing ink and dampening fluid from a form roller after the form roller engages the printing plate. Unused printing ink and dampening fluid is removed from the form roller by an idler roller, and a scraping off means scrapes the mixture directly from the idler roller. The mixture is then returned to the reservoir. The ink and dampening fluid removed from the form roller are blended in the reservoir with fresh ink, and recirculated to a distributor line for application to the form roller. This concept works well for a printing press using a low viscosity news print ink which does not dry quickly onto a continuous media. However, for high quality multi colored sheet fed products, the circulation of ink and wash up requirements is prohibitive.

Another attempt to solve the problem of ghosting is disclosed in U.S. Pat. No. 5,315,930 entitled "KEYLESS INKING SYSTEM FOR A PRINTING PRESS." This patent discloses an inking system for a printing press having an ink injector for supplying ink under pressure, and a device for pumping and metering the ink flow in the injector. The ink injector supplies ink to a fountain roller having an outer brush surface. The fountain roller applies the ink to a pick up roller which transfers the ink through a series of rollers to an applicator roller. The applicator roller has a resilient surface, and applies the ink to two form rollers. A scraper roller engages the applicator roller to remove excess ink therefrom. A scraper blade scrapes ink from the scraper roller. Ink scraped from the scraper roller is transported to an ink reservoir, and is then recirculated using a pump to the ink injector. The inking system in U.S. Pat. No. 5,315,930 has multiple form rollers, and does not provide any means for removing excess ink from the form rollers. In addition, the inking system requires ink recirculation which requires a lengthy wash up time.

All of the patents referred to above have sought to solve "ghosting," starvation, and accumulation problems in inking systems. However, the solutions have complicated the printing press assemblies, require circulating the ink which complicates washing the inker for a color change, and can cause damage to the single form roller.

SUMMARY OF INVENTION

The invention disclosed herein provides a printing press having a keyless inking system. The inking system includes a single form roller for applying ink to a printing plate, and a transfer roller adjacent the form roller for removing excess ink from the form roller. A subtractive roller adjacent the transfer roller removes excess ink from the transfer roller, and a scraper blade adjacent the subtractive roller scrapes excess ink from said subtractive roller. An ink reservoir adjacent the scraper blade receives ink scraped from the subtractive roller, and supplies ink for application onto the form roller. An applicator roller adjacent the ink reservoir receives ink from the ink reservoir, and applies the ink to the form roller.

The scraper blade and doctor blade are preferably mounted in a common blade holder which is movable for simultaneously positioning the scraper blade in engagement with the smooth-surfaced ink subtractive roller and the doctor blade in engagement with the surface of the applicator roller. Space between the scraper blade and the doctor blade forms an ink fountain which receives ink from the subtractive roller and applies ink to the applicator roller. The inking system using a single form roller is capable of removing accumulated ink and applying a fresh film of ink on the form roller to provide a keyless inker which eliminates ghosting, accumulation, and starvation.

A general objective of the present invention is to provide a keyless inking system. This objective is accomplished by providing an inker having a single form roller for applying a uniform film of ink on a printing plate.

Another objective of the present invention is to provide an inker that does not require circulation to simplify washup when changing ink colors. This objective is accomplished by providing an inker which has an ink reservoir interposed between a subtractive roller which deposits excess ink from the form roller therein, and an applicator roller which receives ink from the ink reservoir for application onto the form roller.

The foregoing and other objects and advantages of the invention will appear from the following description. In the description, reference is made to the accompanying drawings which form a part hereof, and in which there is shown by way of illustration a preferred embodiment of the invention.

DESCRIPTION OF THE DRAWINGS

Drawings of a preferred embodiment of the invention are annexed hereto so that the invention may be better and more fully understood, in which.

Numeral preferences are employed to designate like parts throughout the various figures of the drawings.

DESCRIPTION OF A PREFERRED EMBODIMENT

Figure 1:
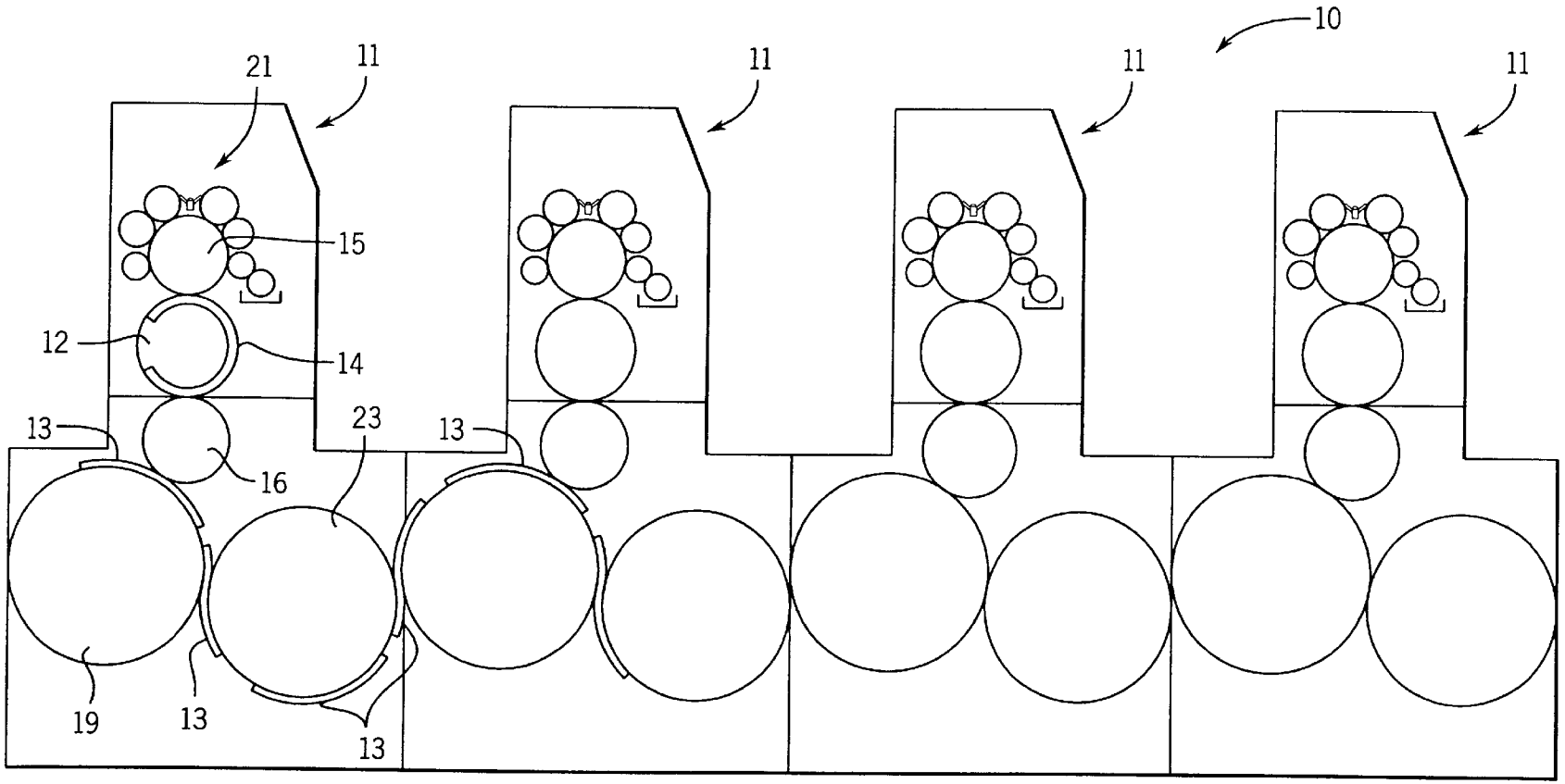
FIG. 1 is a diagrammatic view of a printing press having the keyless inker mounted thereon.

Referring to FIG. 1 of the drawings, the numeral 10 generally designates an offset printing press having a plurality of printing assemblies 11 for sequentially applying a different color ink to media 13, such as paper, plastic, and the like, to produce a multi-colored printed product. The ink is conventional ink, such as a solution of water and chemicals known in the industry, and as referred to herein can also include a mixture of conventional ink and dampening fluid.

Each printing assembly 11 includes a plate cylinder 12 carrying a printing plate 14 containing an image for printing on the media. The image is formed by image areas on the plate 14 which receive ink from a single form roller 15. Ink is applied to the printing plate 14 by an inker 21 to form a transferable inked image thereon corresponding to the image areas on the printing plate 14. The plate cylinder 12 is rotated to engage the printing plate 14 with a rotatably mounted blanket cylinder 16, and transfer the inked image onto the blanket cylinder 16. The blanket cylinder 16 then transfers the inked image to the media which is pinched between the blanket cylinder 16 and an impression cylinder 19. A transfer cylinder 23 adjacent the impression cylinder 19 facilitates the transfer of the media 13 to an adjacent printing assembly 11 for applying a different color image to the media 13.

Figure 2:
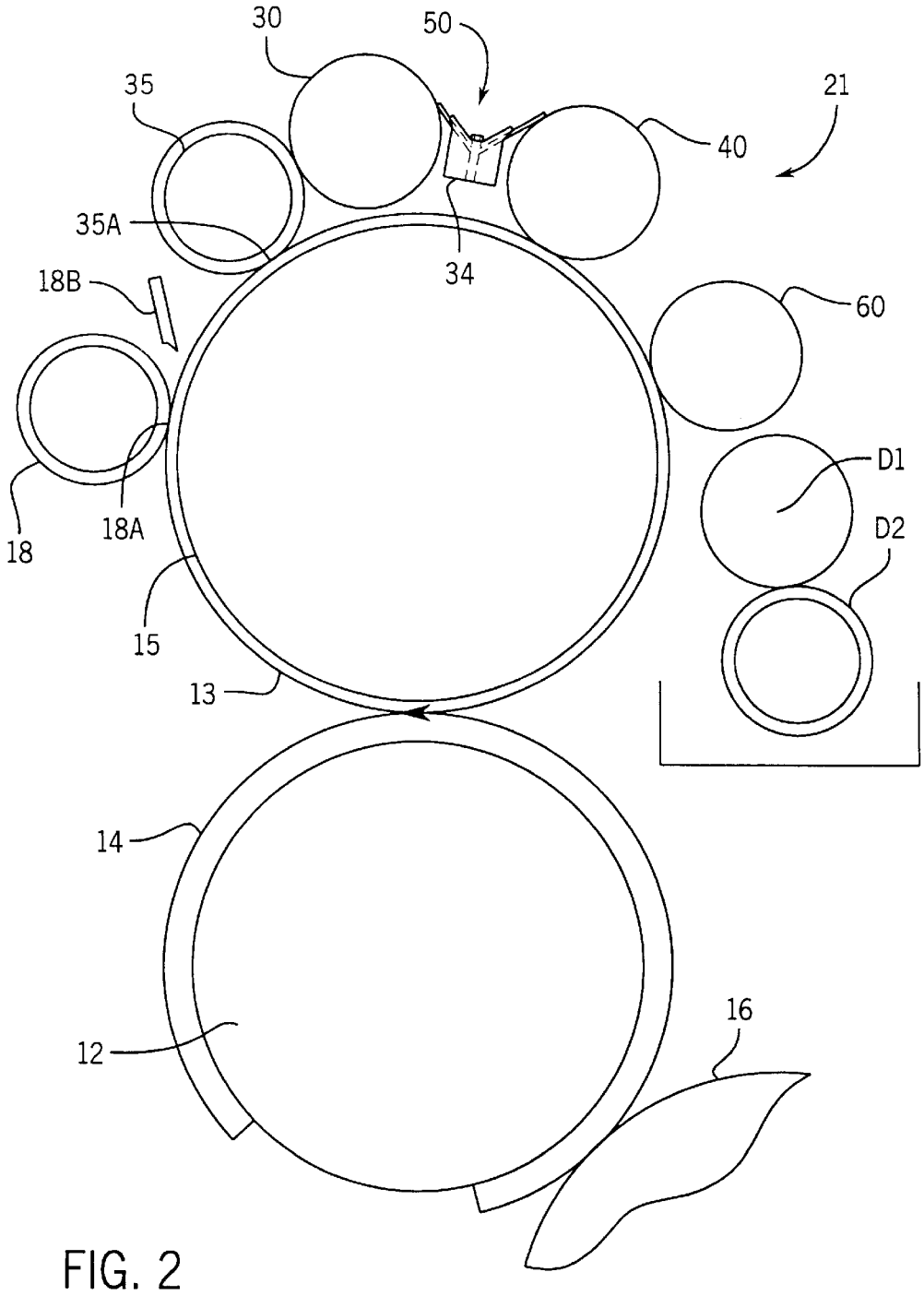
FIG. 2 is a fragmentary cross-sectional view showing the inker of a printing assembly of FIG. 1 in a dry offset printing mode.
Figure 3:
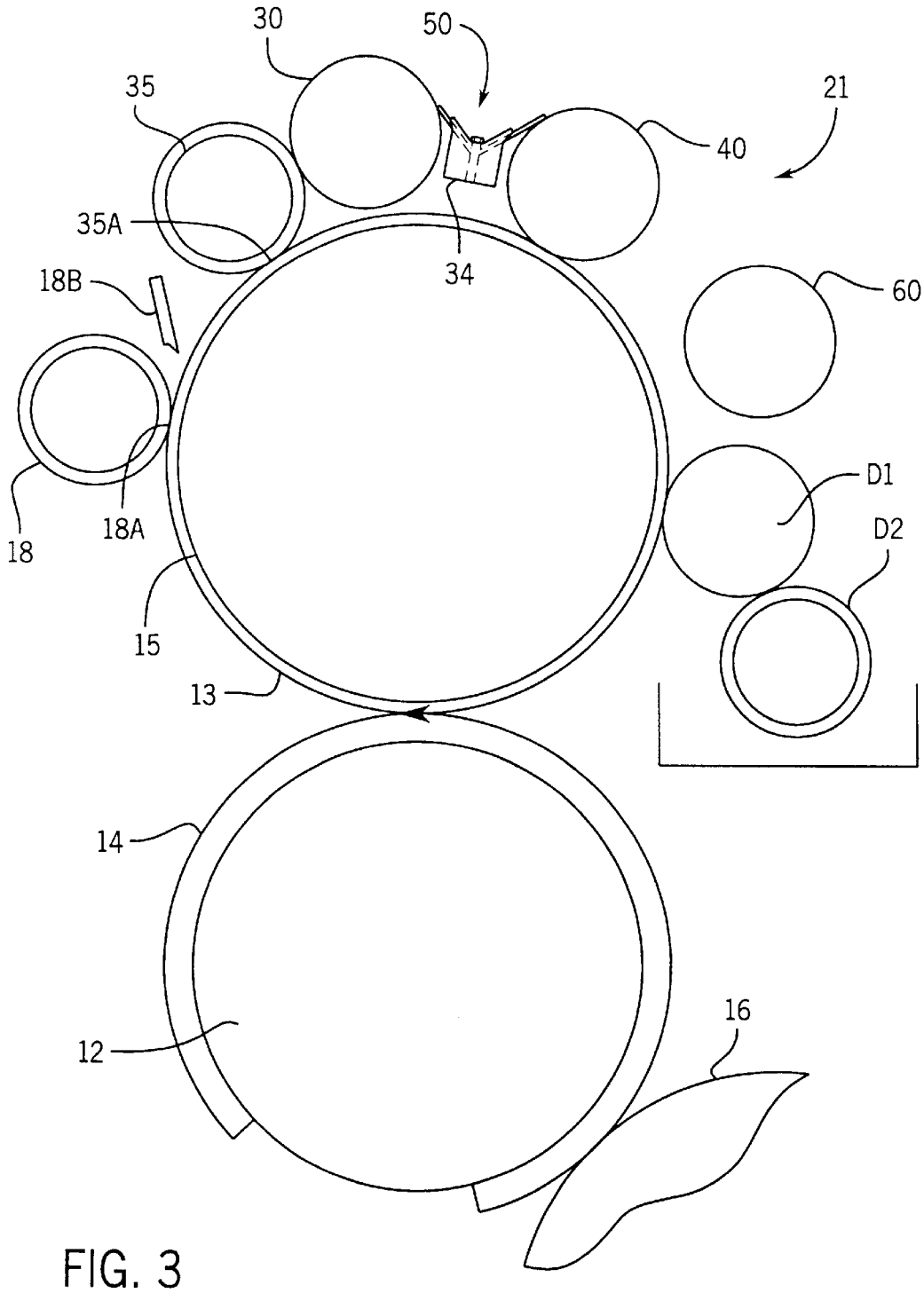
FIG. 3 is a fragmentary cross-sectional view showing the inker of a printing assembly of FIG. 1 in a wet offset printing mode.

Referring to FIGS. 2 and 3, the inker 21 includes a single form roller 15 which applies a film of the ink to the image areas on the printing plate 14. An ink reservoir 50 supplies ink for application to the form roller 15. Additional rotatably mounted rollers described herein apply the ink to the form roller 15, or remove excess ink from the form roller 15 to minimize ink accumulation and starvation which causes ghosting. Advantageously, the excess ink removed from the form roller 15 is deposited directly back into the ink reservoir 50 for application onto the form roller 15 without recirculating the ink.

The single form roller 15 has a resilient surface, and is mounted in rolling engagement with the printing plate 14. Ink on the form roller 15 corresponding to image areas on the printing plate 14 is applied to the printing plate 14, while ink on the form roller 15 corresponding to non-image areas on the printing plate 14 remains on the form roller 15. Preferably, the circumference of the form roller 15 is not equal to the circumference of the printing plate cylinder 12 such that a particular point on the form roller 15 will not repeatedly engage the same point on the printing plate 14.

Figure 6:
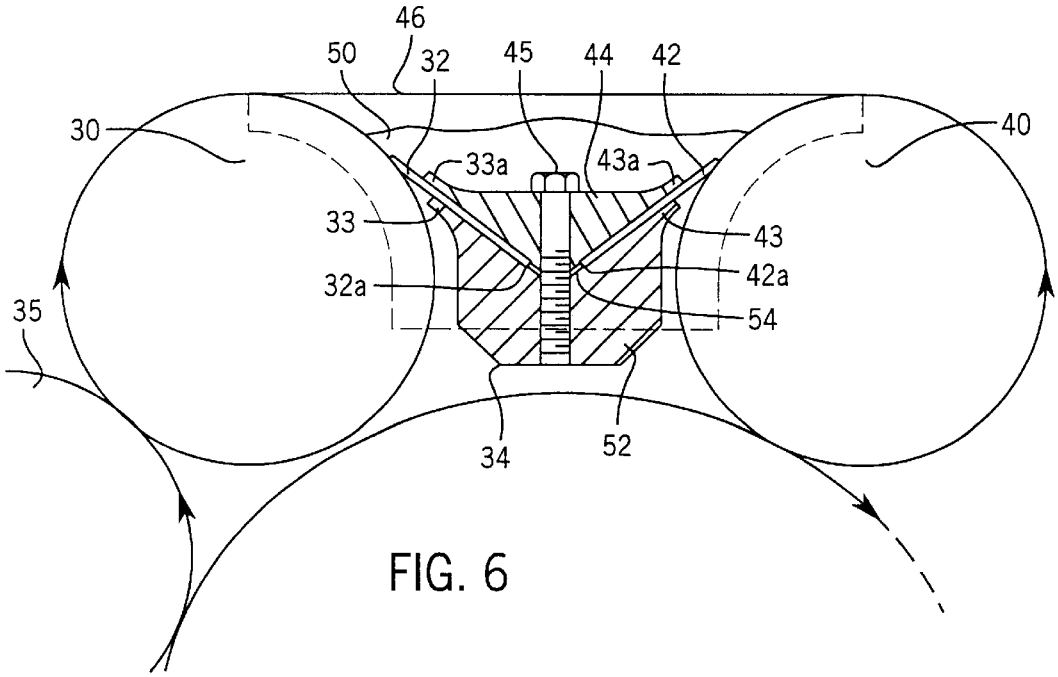
FIG. 6 is a cross sectional view of the ink reservoir of FIG. 1.

A rotatably mounted applicator roller adjacent the form roller 15 receives ink from the ink reservoir 50, and applies it to the form roller 15. Preferably, the applicator roller is an anilox roller 40 having a smooth hard durable surface, such as provided by a ceramic coating, with reservoirs formed therein for carrying ink to the surface of form roller 15. Ink in the ink reservoir 50 flows onto the surface of the anilox roller 40, and is metered by a doctor blade 42 such that a precisely controlled volume of ink is carried by the anilox roller 40 to the form roller 15. Preferably, as shown in FIG. 6, at the nip between the anilox and form rollers 40, 15, the anilox roller 40 is traveling in the same direction as the form roller 15. The anilox roller 40 is driven by a variable speed motor to provide slippage between the anilox roller 40 surface and the form roller 15 surface to control the rate at which ink carried in the anilox roller 40 reservoirs is applied to the form roller 15.

Referring back to FIGS. 2 and 3, oscillating rollers 18, 35 are positioned around the form roller 15 for smoothing the ink film on the form roller 15. Oscillator rollers 18 and 35 preferably have a resilient surface, and rotate in the same direction as the form roller 15, so as not to increase the power requirements for rotating the form roller 15 or damage the form roller 15. The surfaces of form roller 15 and oscillator rollers 18 and 35 are preferably approximately 35 Shore A durometer such that, when the surfaces of oscillating rollers 18 and 35 are urged into pressure indented relation with the surface of form roller 15, the nip 18*a* and the nip 35*a* will be flat nips which generally result in a film split such that half of the ink film is carried by each roller surface moving out of the nip.

Resilient covered oscillator roller 18 and resilient covered oscillator roller 35 oscillate longitudinally in opposite directions for smoothing the image carried on the surface of form roller 15. It should be readily apparent that, if oscillator roller 35 is moving at a surface speed greater than the surface speed of the form roller 15, it will act as a transfer roller, and carry more ink out of the flat nip 35*a* than is carried out of the nip on the surface of form roller 15. Preferably, the surface speed of roller 35 is adjustable for controlling the rate at which ink is removed from the surface of form roller 15. A gear 37 mounted at one end of the oscillator roller 35 rotatably drives the adjacent subtractive roller 30.

Oscillator roller 35 removes excess ink from the surface of the form roller 15 to prevent ink accumulation, and transfers it to the smooth surface of a subtractive roller 30. Preferably, as shown in FIG. 6, at the nip between the subtractive and oscillator rollers 30, 35, the subtractive roller 30 is traveling in the same direction as the oscillator roller 35 to minimize the power requirements required to rotate the rollers 30, 35. The subtractive roller 30 has a smooth surface which is harder than the oscillator roller 35 surface, such as provided by a ceramic coating, to facilitate the ink transfer. Ink on the subtractive roller 30 is scraped directly into the ink reservoir 50 by a scraper blade 32 which forms a part of the ink reservoir.

Figure 5:
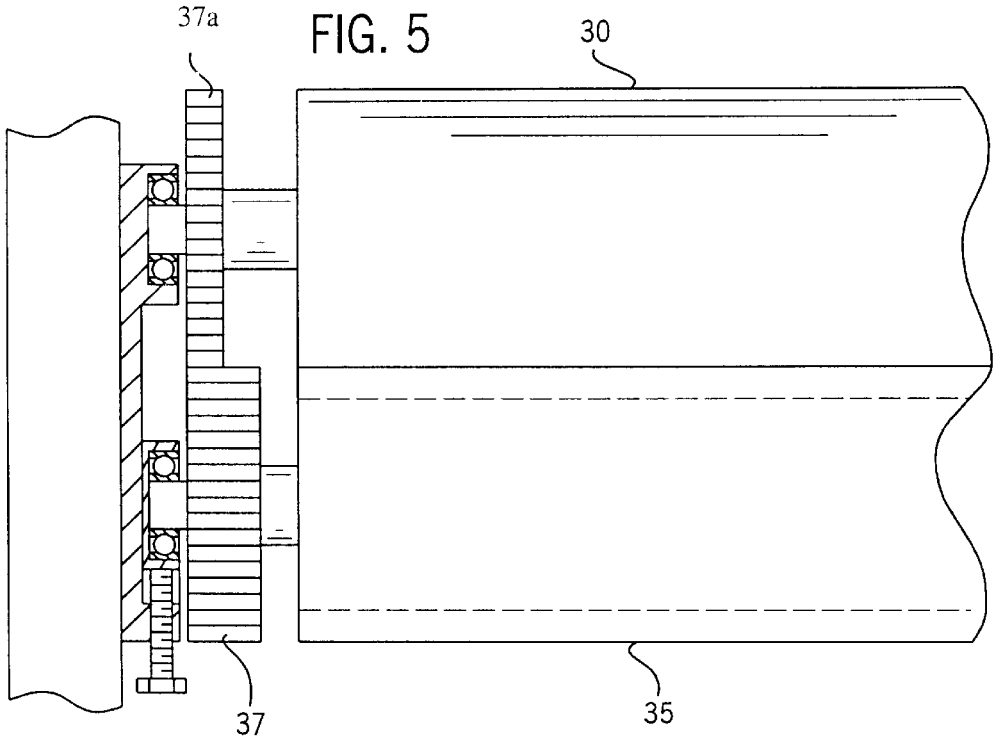
FIG. 5 is a fragmentary view of the subtractive roller in engagement with the oscillator roller of FIG. 2.

Preferably, subtractive roller 30 is rotatably driven by a gear 37*a*, shown in FIG. 5, which is mounted on one end of roller 30. The gear 37*a* engages gear 37 on roller 35 to rotatably drive the subtractive roller 30. Roller 35 is preferably driven by a variable speed motor (not shown) such that the rate at which ink is removed from the form roller 15 can be controlled. Although, a single motor driving roller 35 and roller 30 is preferred, each roller 30 and 35 can be individually motor driven without departing from the scope of the present invention.

The oscillating roller 35, subtractive roller 30, and anilox roller 40 are preferably rotatably driven at surface speeds different from the surface speed of the form roller 15. The oscillating roller 35 is preferably driven in a range between about 2% and 5% faster than the surface speed of form roller 15 for removing more than one-half of the ink film from the surface of form roller 15. Thus, the oscillating transfer roller 35 is capable of efficiently removing ink from the surface of form roller 15 to prevent accumulation of excess ink on the form roller 15 surface.

As shown in FIG. 6, the ink reservoir 50 supplies ink to the anilox roller 40 for application to the form roller 15, and receives excess ink from the subtractive roller 30. The ink reservoir 50 is positioned between the subtractive roller 30 and the anilox roller 40, such that ink removed from the subtractive roller 30 is deposited directly into the ink reservoir 50, and ink in the reservoir is applied directly to the anilox roller 40. Additional ink is also supplied to the ink reservoir to ensure the ink level in the reservoir 50 is sufficient for continuously feeding the anilox roller 40. Advantageously, by positioning the ink reservoir between the subtractive roller and the metering roller, recirculation of the ink is not required. Furthermore, by individually metering the ink onto the form roller 15, and removing the ink from the form roller 15, the film on the form roller 15 can be controlled more precisely than the prior art without increasing the power requirements for rotating the form roller 15.

The ink reservoir 50 includes an adjustable blade holder 34 having a doctor blade 42 and a scraper blade 32 mounted thereto. The blades 32, 42 form a trough extending past the length of the anilox roller 40 and the subtractive roller 30. The trough holds a mass of the ink, commonly referred to as an ink fountain.

The blade holder 34 is adjustable relative to each of the rollers 30 and 40 to position the trough therebetween. Blade holder 34 is adjustable vertically in a slide block (not shown) for positioning scraper blade 32 and doctor blade 42 in engagement with the subtractive roller 30 and the anilox roller 40, respectively. Blade holder 34 preferably is rotatable about its longitudinal axis relative to the slide block for adjusting pressure of scraper blade 32 relative to the pressure of doctor blade 42.

The blade holder 34 comprises a base 52 having a pair of projections 33 and 43 extending outwardly from opposite sides thereof with a relieved area 54 forming shoulders 32*a* and 42*a* adjacent opposite ends thereof for positioning scraper blade 32 and doctor blade 42. A blade clamp 44 is configured to be received in the base relieved area 54, and has projections 33*a* and 43*a* adjacent opposite sides thereof. A bolt 45 extends through blade clamp 44, and is received in a threaded aperture in base 52 for grippingly engaging scraper blade 32 and doctor blade 42 between the blade clamp 44 and base 54.

When clamped on the blade holder 34, the scraper blade 32 extends away from one side of the blade holder 34, and engages the subtractive roller 30 to scrape excess ink therefrom. The doctor blade 42 extends away from the opposite side of the blade holder 34 toward the anilox roller 40 to meter the application of ink thereon. Preferably, the scraper blade 32 and doctor blade 42 scrape and meter the respective rollers 30 and 40 above a line extending through longitudinal axes of the rollers 30, 40, and are preferably formed of fiber glass material.

End dams 46 are positioned adjacent opposite ends of blade holder 34, scraper blade 32, and doctor blade 42 for capping each end of the trough. A cavity is formed in an inwardly directed face of each end dam 46 to receive the blade holder 34 and blades 32, 42, and sealingly cap the ends of the trough. The volume of ink extends above upper ends of scraper blade 32 and doctor blade 42 to assure that ink is always present to provide lubrication between the scraper blade 32 and the surface of subtractive roller 30, and to provide sufficient ink between the doctor blade 42 and the surface of the anilox roller 40 for application to the surface of the form roller 15.

Figure 4:
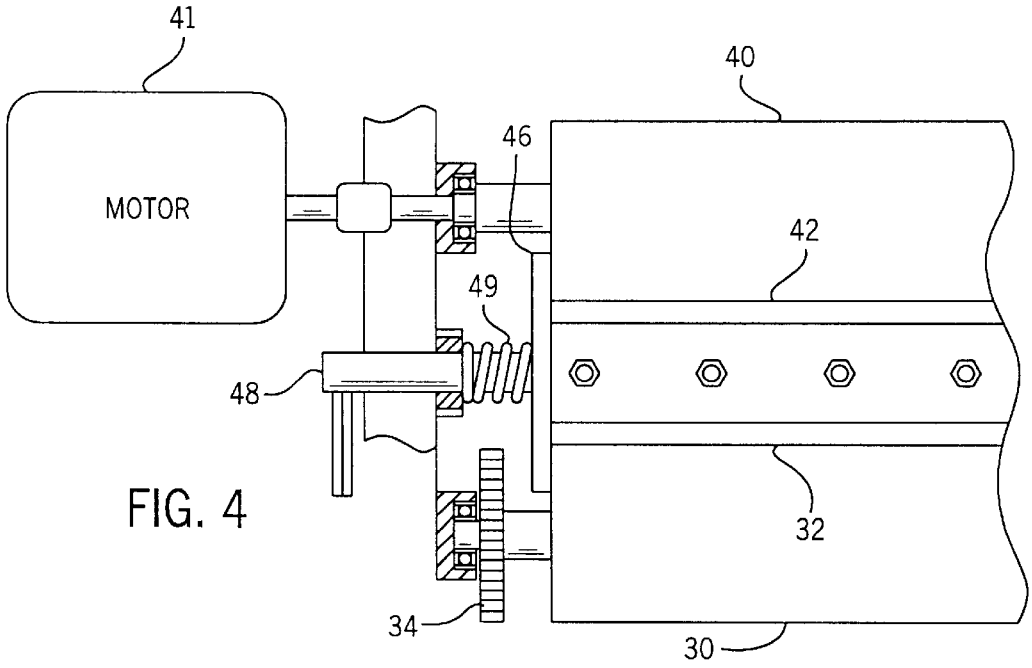
FIG. 4 is a fragmentary top view of the inker of FIG. 1.
Figure 7:
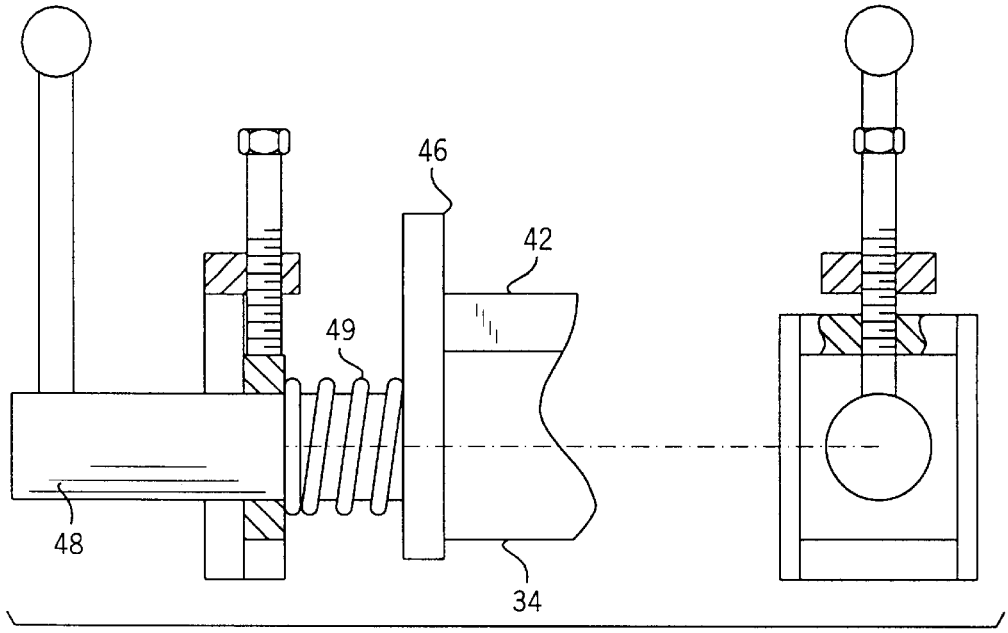
FIG. 7 is a detailed view of the end dam assembly of the ink reservoir of FIG. 6.

As best illustrated in FIGS. 4 and 7, the end darns 46 are preferably mounted on slidable bearers 48, and sealingly engage ends of the subtractive roller 30 and the anilox roller 40. The inwardly facing end dam surfaces engaging the rollers 30, 40, as well as the ends of the rollers 30 and 40, are provided with a coating which forms smooth self-lubricating surfaces to allow rotation of the rollers 30, 40 when engaging the end dams 46. The bearers 48 do not rotate and are preferably spring 49 biased to urge the end darns 46 against the roller ends to prevent the ink from leaking out of the trough.

As shown in FIG. 2, when printing in a dry offset mode, a chill roller 60 which is internally cooled and has an outer surface which is a good thermal conductor can be provided. The chill roller 60 cools the ink to a specific temperature for printing in the dry offset mode. If the inking system hereinbefore described is used in a printing press printing in a dry offset printing mode, chill roller 60 will be urged into pressure indented relation with the surface of form roller 15, and chill water will be circulated through roller 60. The chill roller 60 maintains ink moving out of the nip between the surface of form roller 15 and chill roller 60 within a predetermined temperature range of, for example, about 67° to 72° F.

As shown in FIG. 3, if the inking system is used in a printing press printing in a wet offset printing mode, such as in lithographic printing, chill roller 60 is not necessary. A dampening system, for example of the type commercially available from Epic Products International Corporation, Arlington, Tex. can be provided for applying a precisely metered film of dampening fluid to the surface of ink carried on form roller 15. Such a dampener generally comprises a pan for dampening fluid and a resilient covered roller D2 moving through dampening fluid in the pan. The roller D2 forms a flooded nip between a hydrophilic chrome roller D1 and the resilient covered pan roller D2. A thin film of ink dampening fluid carried by the hydrophilic chrome roller D1 is applied to the film of ink on form roller 15. An air knife 18B is mounted to evaporate dampening fluid from the surface of oscillator roller 18 which is positioned to remove dampening fluid from the surface 13 of form roller 15.

Preferably, the blade clamp 44, scraper blade 32, and doctor blade 42 are assembled as a single removable unit from blade holder base 52, such as by attaching the blades 32, 42 to the blade clamp 44 using methods known in the art, such as bolting, welding, and the like, to simplify the color change procedure in the printing assembly 11. The removable unit is removed from the inker 21 during color change for inker wash up purposes, and replaced with a wash up assembly 70, shown in FIG. 8. The wash up assembly 70 is installed in the removable unit location to collect ink cleaned out of the printing assembly 11.

Figure 8:
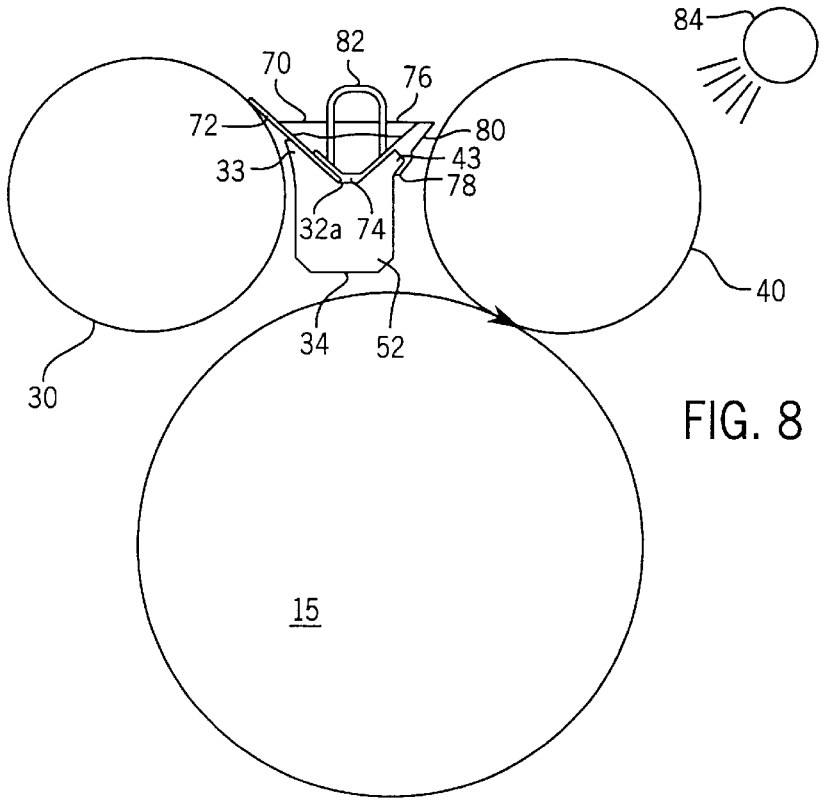
FIG. 8 is a cross sectional view of a wash up blade and tray assembly for use with the ink reservoir of FIG. 6.

As shown in FIG. 8, the wash up assembly 70 includes a wash up blade 72 contacting the subtractive roller 30 for scraping ink and wash up solution off of the subtractive roller 30, and a blade clamp 74. The wash up blade 72 is clamped to the blade holder base 52 by the blade clamp 74, and in combination with the blade clamp 74 and end darns 76, forms a trough for collecting the ink and wash up solution from the inker 21 during a color change. Preferably, the wash up blade 72 and blade clamp 74 are assembled as a single removable unit to simplify installation and removal of the assembly 70 from the inker 21, such as by attaching the wash up blade 72 to the blade clamp 74 using methods known-in the art, such as bolting, welding and the like.

The blade clamp 74 includes a flange 78 which wraps around the blade holder base projection 43 adjacent the applicator roller 40 to lock the blade clamp 74 onto the blade holder base 52. The flange 78 locks onto the base projection 43 when the rotating subtractive roller 30 exerts a downward force on the wash up blade 72 attached to the blade clamp 74, thus eliminating the need to secure the blade clamp 74 to the base 52 with a bolt, or the like. The blade clamp 74 can, however, be secured to the base 52 using methods known in the art, such as a bolt, without departing from the scope of the present invention. A lip 80 extending upwardly from a side of the blade clamp 74 opposite the wash up blade 72 forms the trough in cooperation with the wash up blade 72. Handles 82 attached to ends of the blade clamp 74 allow a user to grasp the assembly 70 when installing or removing the assembly 70 from the inker 21.

A spray bar 84 adjacent the applicator roller 40 sprays wash up solution on to the surface of the applicator roller 40 which applies the solution to the form roller 15. The wash up solution flushes ink from the rollers in the inker 21, and is collected in the wash up assembly 70 trough. When the wash up process is complete, the wash up assembly 70 is removed, and a clean blade clamp, scraper, blade, and doctor blade are installed. The collected ink and wash up solution in the wash up assembly 70 trough are discarded.

While there has been shown and described what are at present considered the preferred embodiment of the invention, it will be obvious to those skilled in the art that various changes and modifications can be made therein without departing from the scope of the invention.

I claim:

1. An inking system comprising:

a form roller for applying ink to a printing plate;

a transfer roller adjacent said form roller for removing excess ink from said form roller;

a substractive roller adjacent said transfer roller for receiving excess ink from said transfer roller;

a scraper blade adjacent said substractive roller for scraping excess ink from said substractive roller;

an ink reservoir adjacent said scraper blade for receiving ink scraped from said substractive roller, and supplying ink for application onto said form roller; and an applicator roller interposed between said ink reservoir and said form roller, wherein ink from said ink reservoir is applied to said form roller by said applicator roller.

2. The inking system as in claim 1, in which said scraper blade forms part of the ink reservoir which supplies ink to said form roller.

3. The inking system as in claim 1, including a doctor blade forming a part of said ink reservoir, wherein said doctor blade meters ink from said ink reservoir onto said applicator roller.

4. The inking system as in claim 1, in which said transfer roller includes a resilient surface in contact with a surface of said form roller.

5. The inking system as in claim 1, in which said subtractive roller includes a surface in contact with a surface of said transfer roller, and said subtractive roller surface is harder than said transfer roller surface.

6. An inking system comprising:

a single form roller for applying ink to a printing plate;

a transfer roller adjacent said form roller for removing excess ink from said form roller;

a subtractive roller adjacent said transfer roller for receiving excess ink from said transfer roller;

a scraper blade adjacent said subtractive roller for scraping excess ink from said subtractive roller;

an ink reservoir adjacent said scraper blade for receiving ink scraped from said subtractive roller, and supplying ink for application onto said form roller; and an applicator roller interposed between said ink reservoir and said form roller, wherein ink from said ink reservoir is applied to said form roller by said applicator roller.

7. The inking system as in claim 5, in which said subtractive roller surface is formed from ceramic.

8. A printing press comprising an inking system as claimed in claim 1.

9. A keyless inking system for use in inking a form roller, the keyless inking system comprising:

a first roller for applying ink to the form roller;

a transfer roller adjacent the form roller for removing excess ink from the form roller;

a second roller for receiving excess ink from said transfer roller; and an ink reservoir interposed between said first and second rollers, wherein excess ink from said second roller is deposited directly into said ink reservoir, and ink from said ink reservoir is deposited directly onto said first roller for applying to the form roller.

10. The inking system as in claim 9, including a doctor blade having one end adjacent said first roller for applying ink from said ink reservoir onto said first roller.

11. The inking system as in claim 9, including a scraper blade having one end adjacent said second roller for scraping excess ink from said second roller and guiding the ink into said ink reservoir.

12. The inking system as in claim 9 in which said ink reservoir includes a blade holder, first and second blades extending outwardly from said blade holder forming a trough therebetween, and end dams adjacent opposite ends of the trough to hold the ink therein.

13. The inking system as in claim 12, in which said first blade is a doctor blade having one end adjacent said first roller for applying ink from said ink reservoir onto said first roller.

14. The inking system as in claim 13, in which said second blade is a scraper blade having one end adjacent said second roller for scraping excess ink from said second roller and guiding the ink into said ink reservoir.

15. The inking system as in claim 9, including a third roller for removing excess ink from the form roller, and transferring the ink to said second roller.

16. The inking system as in claim 15, in which said third roller includes a resilient surface in contact with a surface of the form roller.

17. The inking system as in claim 16, in which said second roller includes a surface in contact with said third roller surface, and said second roller surface is harder than said third roller surface.

18. The inking system as in claim 16, in which said second roller surface is formed from ceramic.

19. A printing press comprising an inking system as claimed in claim 10.

20. A method for inking a form roller comprising the steps of:

applying ink directly onto a form roller from a first roller;

transferring excess ink from the form roller onto a second roller;

transferring excess ink from the second roller onto a third roller;

scraping excess ink from the third roller directly into an ink reservoir; and applying ink onto said first roller directly from said ink reservoir.

21. A keyless inking system comprising:

a form roller;

an ink reservoir;

an applicator roller for applying ink to the form roller;

a doctor blade for metering ink from the reservoir onto the applicator roller;

means for driving the applicator roller at a surface speed different from that of the form roller to control the rate at which ink is applied to the form roller; and a subtractive roller system for removing excess ink from the form roller comprising:

a transfer roller adjacent the form roller for removing excess ink from the form roller, a hard surface subtractive roller adjacent the transfer roller for receiving excess ink from the transfer roller, and a scraper blade adjacent the subtractive roller for scraping excess ink from the subtractive roller and depositing the excess ink in the reservoir.

22. The inking system of claim 21, wherein the form roller has a removable covering.

23. The inking system of claim 21, wherein the ink reservoir is defined in part by the scraper blade and the doctor blade.

24. The inking system of claim 23, wherein the ink reservoir is located above the form roller between the applicator roller and the subtractive roller.

25. The inking system of claim 21, wherein the transfer roller is driven to oscillate.

26. The inking system of claim 21, further comprising means of applying wash-up fluid to the inking system rollers during wash-up.

27. The inking system of claim 26, wherein the wash-up fluid applying means includes a wash-up fluid spray bar for spraying wash-up fluid on at least one roller of the inking system.

* * * * *